US008931998B2

(12) United States Patent
Smith

(10) Patent No.: US 8,931,998 B2
(45) Date of Patent: Jan. 13, 2015

(54) BARRIER COLLECTION SYSTEM

(75) Inventor: Ronald Smith, Kidderminster (GB)

(73) Assignee: Birmingham Barbed Tape Ltd., Kidderminster, Worchestershire (GB)

( * ) Notice: Subject to any disclaimer, the term of this patent is extended or adjusted under 35 U.S.C. 154(b) by 294 days.

(21) Appl. No.: 13/451,823

(22) Filed: Apr. 20, 2012

(65) Prior Publication Data

US 2012/0269608 A1 Oct. 25, 2012

(30) Foreign Application Priority Data

Apr. 20, 2011 (ZA) ..... 2011/02953

(51) Int. Cl.
*F41H 11/11* (2006.01)
*E04H 17/26* (2006.01)

(52) U.S. Cl.
CPC ..... *F41H 11/11* (2013.01); *E04H 17/261* (2013.01)
USPC ..... 414/525.1

(58) Field of Classification Search
CPC ..... B65G 25/065; B65H 55/585; B65F 3/20; A01D 87/125; A01D 46/084; A01D 90/00
USPC ..... 414/525.1; 254/10.5, 223
See application file for complete search history.

(56) References Cited

U.S. PATENT DOCUMENTS

| | | | | |
|---|---|---|---|---|
| 1,057,901 | A * | 4/1913 | Turner | 254/223 |
| 3,653,606 | A * | 4/1972 | Sheets, Jr. | 242/390 |
| 3,825,228 | A * | 7/1974 | Greutman | 254/237 |

FOREIGN PATENT DOCUMENTS

| | | |
|---|---|---|
| WO | 2005090716 | 9/2005 |
| ZA | 9810149 | 5/1999 |

* cited by examiner

*Primary Examiner* — Saul Rodriguez
*Assistant Examiner* — Emery Hassan
(74) *Attorney, Agent, or Firm* — Michael Best & Friedrich LLP

(57) ABSTRACT

A barrier recovery device for receiving an elongate array of coils which includes a boom and a catch which is reciprocally movable along the boom to draw successive portions of the coils, in an axially compressed stated, onto the boom. The device can be mounted to a barrier recovery vehicle.

20 Claims, 3 Drawing Sheets

BARRIER COLLECTION SYSTEM

BACKGROUND OF THE INVENTION

This patent application claims foreign priority to South African Patent Application No. 2011/02953, filed 20 Apr. 2011, the disclosure of which is incorporated by reference herein in its entirety. Priority to this application is hereby claimed.

This invention relates to the collection of a barrier which, when deployed, comprises an elongate array of interconnected flexible wire coils.

A barrier of the aforementioned kind is described, for example, in the specification of South African patent No. 98/10149. When inoperative this type of barrier is stored, in a compact form, on a trailer or similar vehicle. If the barrier is to be made operative then the vehicle is moved along a path on which the barrier is to be erected while the barrier is being payed out. This can be done in an effective and rapid manner.

The recovery of the barrier can however be tedious. The wire coils which make up the barrier have substantial resilience and carry barbs or spikes which are dangerous. Different techniques have been proposed to mechanise the recovery process.

For example South African patent No. 2006/08423 (which is related to WO2005/090716) describes a recovery device based on the use of a looped chain which moves continuously in one direction, drawing the barrier onto a boom. To the applicant's knowledge this recovery device is complex, and does not work satisfactorily.

An object of the present invention is to provide an improved apparatus for collecting a barrier.

SUMMARY OF THE INVENTION

The invention provides an apparatus for collecting a barrier which includes an elongate array of interconnected flexible coils, the apparatus including a support boom, a drive mechanism, a base member which is reciprocally movable by the drive mechanism, relative to the support boom and a catch which is mounted to the base member and which is movable to an inoperative position when the base member is moved in a first direction and which, when the base member is moved in a second direction which is opposite to the first direction, is movable to an operative position at which the catch is engageable with at least one coil, whereby part of the barrier is drawn, in an axially compressed state, onto the support boom.

The support boom may include a first end which is secured to an appropriate support structure and a second end which is positioned so that it extends into an interior of one or more adjacent coils. The second end may be curved downwardly to facilitate this process.

The drive mechanism may include a flexible drive element, such as a chain, which is in a closed loop. The base member, which is engaged with the drive mechanism, is preferably positioned to travel on a path which is parallel to the support boom. In a preferred form of the invention the base member is positioned to travel on a path which is directly below, and adjacent, the boom.

The catch may extend upwardly from the base member. The catch is preferably pivotally mounted to the base member. A biasing device such as a spring may be positioned to act between the base member and the catch and exert a biasing force on the catch which tends to move the catch to the operative position. A suitable stop may be provided on the base member which prevents movement of the catch beyond the operative position when the catch is moved away from the inoperative position.

The drive mechanism may include a prime mover such as an electric motor, a petrol or diesel engine, a hydraulic device or the like. The invention is not limited in this regard.

Preferably the apparatus includes a control unit which is operable by a technician and which allows the reciprocating movement of the base member to be controlled. The control which is exerted in this way may be in respect of at least one of the following: a speed of movement of the base member; a distance over which the base member is moved; a period for which the base member is moved; and a period for which the base member is stationary.

The invention further extends to a barrier recovery vehicle which includes a load area and apparatus of the aforementioned kind mounted to the load area.

BRIEF DESCRIPTION OF THE DRAWINGS

The invention is further described by way of example with reference to the accompanying drawings in which.

DESCRIPTION OF PREFERRED EMBODIMENT

Figure 1:
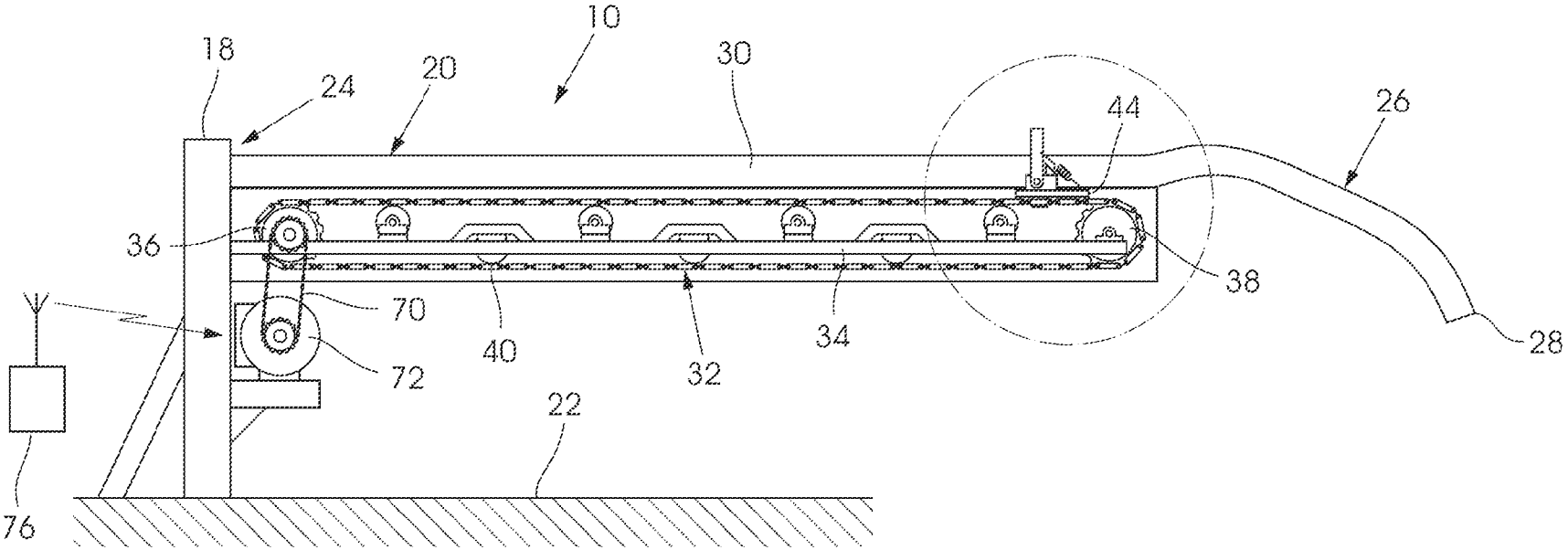
FIG. 1 is a side view of apparatus according to the invention.
Figure 5:
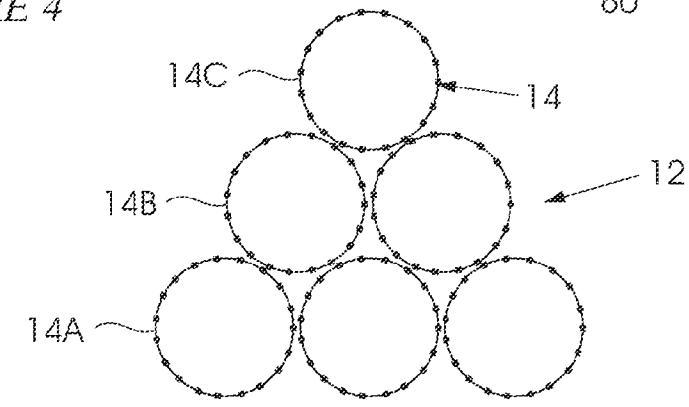
FIG. 5 shows a barrier with which the apparatus is usable.

FIG. 1 of the accompanying drawings illustrates, from one side, apparatus 10, according to the invention, which is intended for use in collecting an elongate barrier 12, a portion of which is schematically shown in FIG. 5. This type of barrier is described for example in the specification of South African patent No. 98/10149.

FIG. 5 shows, only by way of example, a possible form of construction of the barrier which includes six coils 14 of razor wire arranged in a lowermost layer 14A of three adjacent coils, a second layer 14B of two coils positioned on the lowermost layer, and an uppermost coil 14C arranged on the second layer so that, in cross-section, the coil configuration is generally triangular. Each coil, of razor wire or the like, comprises a plurality of helical windings. Adjacent coils are tied to each other in a manner which allows the windings to be compressed in an axial direction so that the barrier is arrangeable in a compact form which is suitable for storage or transport purposes but so that the compacted barrier can be expanded, in an axial direction, by displacing adjacent windings apart to a configuration of substantial elongate dimensions.

The barrier is readily deployed by moving a vehicle, from which the barrier, in a compressed state, is payed out, along a path on which the barrier is to be erected. As noted in the preamble to this specification, however, recovery of the barrier is not easily accomplished. The apparatus 10 is designed to allow the barrier to be recovered in a mechanised manner.

The apparatus 10 is mounted to a suitable recovery vehicle, not shown. The apparatus includes a pedestal 18 and an elongate support boom 20 which extends over a load area 22 of the vehicle. The boom, which is secured at a first end 24 to the pedestal, projects to a rear of the vehicle over the load area 22, and curves downwardly over a region 26 to a lower second end 28.

A major portion 30 of the support boom is elongate and generally horizontal.

Figure 3:
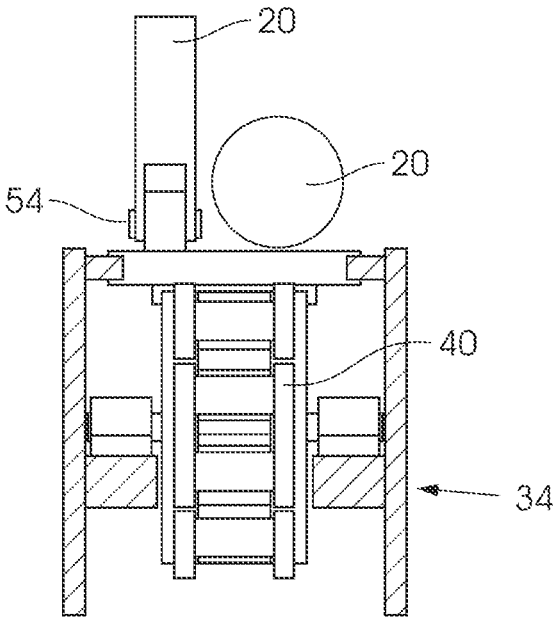
FIG. 3 is a cross-sectional view taken on a line 3-3 in FIG. 2 of the apparatus of the invention.

A drive mechanism 32, positioned below and parallel to the portion 30, includes a support structure 34 with chain sprockets 36 and 38 respectively at opposed ends of the support structure. An endless chain 40 passes over the sprockets which are centrally positioned in the support structure—see FIG. 3. A base member 44, attached to the chain 40, is positioned so that it can move horizontally together with the chain alongside the boom 20.

Figure 2:
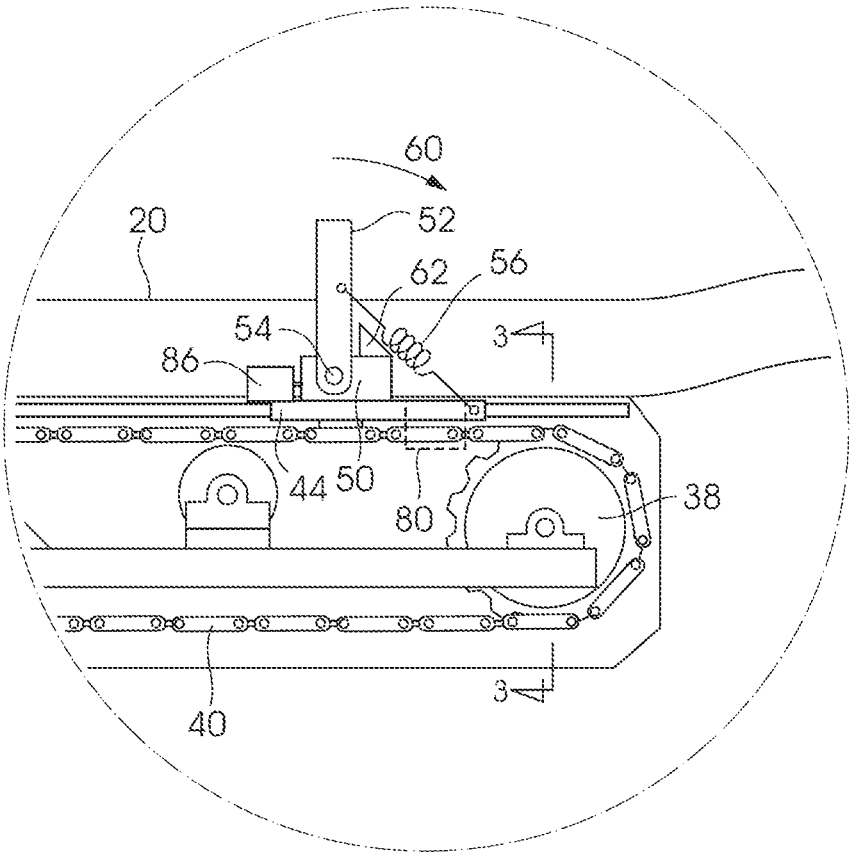
FIG. 2 is a view on an enlarged scale of a portion of the apparatus shown in FIG. 1.

The base member, on an upper surface, has a bracket 50 and a catch 52 is pivotally mounted to the bracket at a point 54. A spring 56 acts between the base member and the catch and, in the illustrated example, tends to urge the catch in a direction 60. A stop 62, projecting upwardly from the bracket, prevents the catch 52 from moving beyond the illustrated vertical position (FIG. 2) in the direction 60.

The sprocket 36 is linked by a chain drive 70 to a prime mover 72. The prime mover may be an electric motor which is battery driven, a petrol or diesel engine, a hydraulic system or the like. The invention is not limited in this regard. The direction of drive imparted by the prime mover to the chain 40 can be reversed using any appropriate technique known in the art. For example a small gearbox could be employed for this purpose, or the drive from the prime mover could be reversible. Preferably the drive process is controlled by means of a control unit 76 which allows the operation of the prime mover to be controlled, preferably wirelessly e.g. by means of a radio signal. Suitable control functions include the following: starting and stopping of the prime mover; reversal of the drive direction of the prime mover; varying the speed of movement of the prime mover; varying the period for which the prime mover is actuated; and varying the period for which the prime mover is inoperative.

FIG. 5 schematically illustrates a portion of the barrier 12. Each coil 14 is made up of helically disposed windings 80A, 80B, . . . 80N etc. These windings are usually made from tensile wire of substantial resilience.

Figure 4:
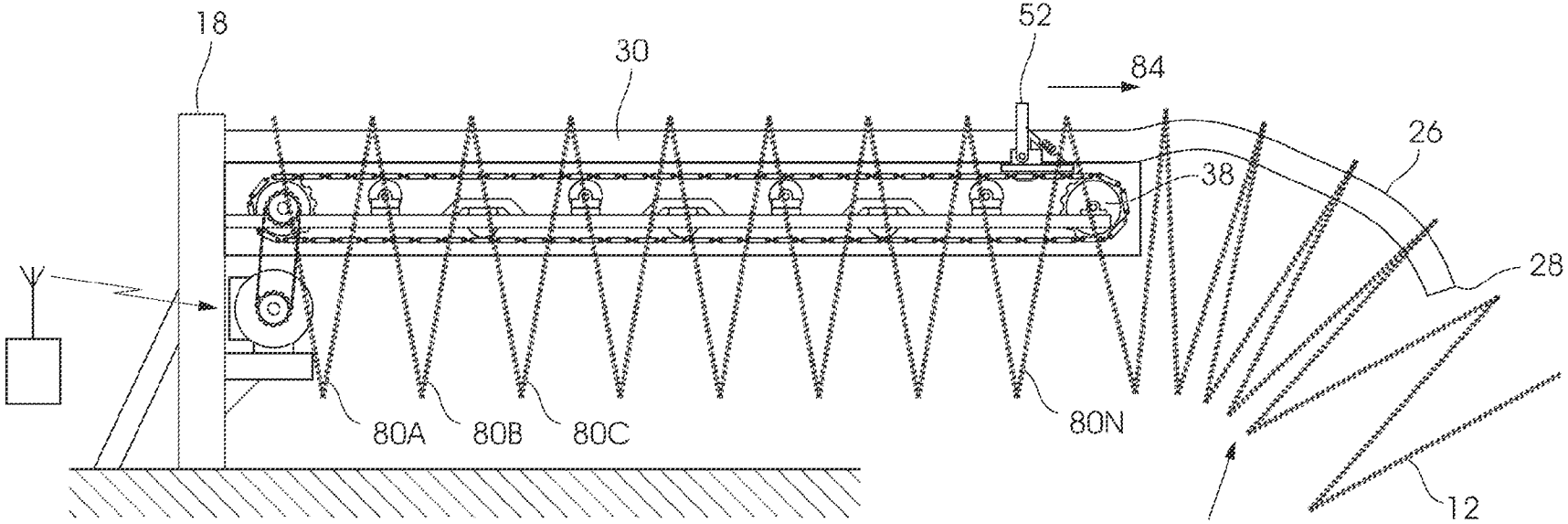
FIG. 4 is a side view, similar to FIG. 1, illustrating the apparatus in use.

In use of the apparatus the recovery vehicle is positioned so that the second end 28 of the support boom enters an interior of an elongate array of a number of the windings 80, typically the windings in the uppermost coil 14C adjacent a rear of the vehicle—see FIG. 4. As the vehicle is moved towards the barrier there is a natural tendency for the windings to move up the curved region 26 onto the elongate horizontal portion 30. A technician, not shown, then operates the prime mover. The base member is caused to move in a first direction 84 in a controlled manner alongside the boom towards the sprocket 38. Windings 80 on the boom successively strike the catch 52.

If a leading winding 80A is anchored to the pedestal 18 then movement in the first direction 84 results in the catch 52 bending downwardly as each winding is traversed. Movement of the base member towards the sprocket 38 can be detected using a suitable limit switch 86 (shown in FIG. 2) so that, at this point, the drive from the prime mover is automatically stopped. The drive direction from the prime movement is then reversed. The spring-loaded catch 52 is then brought into contact with an adjacent winding 80. As the catch is backed by the stop 62, movement of the catch towards the pedestal causes the windings between the pedestal and the catch to be compressed in an axial direction. Some of the windings, trailing the catch, are thus drawn up onto the boom.

With each reciprocating stroke of the base member 44 additional windings are brought onto the boom by the catch. The length of the stroke of the base member is reduced as compressed windings accumulate on the boom adjacent the pedestal. The collection of windings should be carefully monitored by the technician so that corresponding movement of the base member, and thus of the catch, ensues. To prevent an overload of the prime mover when the base member is moved towards the pedestal, if the drive direction of the prime member is inadvertently not reversed, a suitable sensor can be employed to stop movement of the prime mover. For example, if the prime mover is electrically driven by means of a motor, a current sensor which is responsive to electrical current drawn by the motor, can be used to avoid an overload condition.

As the coil collection process continues it is desirable, from time to time, for the recovery vehicle to be moved towards an uncollected portion of the barrier still on the ground. This reduces the load imposed on the prime mover.

The invention makes it possible for a barrier comprising a number of elongate helical coils to be recovered in a mechanised manner.

The invention claimed is:

1. An apparatus for collecting a barrier which includes at least one elongate array of interconnected flexible coils, the apparatus comprising:

a support boom;

a drive mechanism;

a base member; and a catch which is mounted to the base member, wherein the base member and the catch are reciprocally movable in unison by the drive mechanism, along a length of the support boom, whereby the catch is movable to an inoperative position when the base member is moved in a first direction and which, when the base member is moved in a second direction which is opposite to the first direction, is movable to an operative position at which the catch is engageable with at least one coil, whereby part of the barrier is drawn, in an axially compressed state, onto the support boom.

2. The apparatus according to claim 1 wherein the support boom includes a first end which is secured to a support structure and a second end which is positioned so that it can extend into an interior of one or more adjacent coils.

3. The apparatus according to claim 2 wherein the second end is curved downwardly.

4. The apparatus according to claim 1 wherein the base member is positioned to travel on a path which is parallel to the support boom.

5. The apparatus according to claim 1 wherein the catch is pivotally mounted to the base member and extends upwardly from the base member, the apparatus further including a biasing device which tends to move the catch to the operative position.

6. The apparatus according to claim 1 which includes a control unit which allows the reciprocating movement of the base member to be controlled in respect of at least one of the following: a speed of movement of the base member; a distance over which the base member is moved; a period for which the base member is moved; and a period for which the base member is stationary.

7. A barrier recovery vehicle which includes a load area and an apparatus for collecting a barrier which includes an elongate array of interconnected flexible coils, the apparatus comprising:

a support boom;

a drive mechanism;

a base member; and a catch which is mounted to the base member, wherein the base member and the catch are reciprocally moveable in unison by the drive mechanism, along a length of the support boom, whereby the catch is movable to an inoperative position when the base member is moved in a first direction and, when the base member is moved in a second direction which is opposite to the first direction, the catch is movable to an operative position at which the catch is engageable with at least one coil, whereby part of the barrier is drawn, in an axially compressed state, onto the support boom which is mounted to the load area.

8. The vehicle according to claim 7 wherein the support boom includes a first end which is secured to a support structure and a second end which is positioned so that it can extend into an interior of one or more adjacent coils.

9. The vehicle according to claim 8 wherein the second end is curved downwardly.

10. The vehicle according to claim 7 wherein the base member is positioned to travel on a path which is parallel to the support boom.

11. The vehicle according to claim 7 wherein the catch is pivotally mounted to the base member and extends upwardly from the base member, the apparatus further including a biasing device which tends to move the catch to the operative position.

12. The vehicle according to claim 7 which includes a control unit which allows the reciprocating movement of the base member to be controlled in respect of at least one of the following: a speed of movement of the base member; a distance over which the base member is moved; a period for which the base member is moved; and a period for which the base member is stationary.

13. The vehicle according to claim 7 wherein the base member and the catch are reciprocally moveable in unison by the drive mechanism when the barrier is being collected.

14. The apparatus according to claim 1 wherein the base member and the catch are reciprocally moveable in unison by the drive mechanism when the barrier is being collected.

15. An apparatus for collecting a barrier which includes at least one elongate array of interconnected flexible coils, the apparatus comprising:

a support boom;

a drive mechanism;

a base member which is reciprocally movable by the drive mechanism in a direction substantially parallel to and along the support boom when the barrier is being collected, and a catch which is mounted to the base member and which is movable to an inoperative position when the base member is moved in a first direction and which, when the base member is moved in a second direction which is opposite to the first direction, is movable to an operative position at which the catch is engageable with at least one coil, whereby part of the barrier is drawn, in an axially compressed state, onto the support boom.

16. The apparatus according to claim 15 wherein the support boom includes a first end which is secured to a support structure and a second end which is positioned so that it can extend into an interior of one or more adjacent coils.

17. The apparatus according to claim 16 wherein the second end is curved downwardly.

18. The apparatus according to claim 15 wherein the catch is pivotally mounted to the base member and extends upwardly from the base member, the apparatus further including a biasing device which tends to move the catch to the operative position.

19. The apparatus according to claim 15 which includes a control unit which controls the reciprocating movement of the base member with respect to at least one of the following: a speed of movement of the base member; a distance over which the base member is moved; a period for which the base member is moved; and a period for which the base member is stationary.

20. The apparatus according to claim 15 wherein the base member and the catch are reciprocally moveable in unison by the drive mechanism when the barrier is being collected.

* * * * *